US006659879B1

(12) United States Patent
Cartwright

(10) Patent No.: US 6,659,879 B1
(45) Date of Patent: Dec. 9, 2003

(54) CONVERTIBLE TABLE ASSEMBLY

(76) Inventor: Thomas Cartwright, 10 Perrinwinkle Cir., Sewalls Point, FL (US) 34996

( * ) Notice: Subject to any disclaimer, the term of this patent is extended or adjusted under 35 U.S.C. 154(b) by 0 days.

(21) Appl. No.: 09/976,737

(22) Filed: Oct. 12, 2001

(51) Int. Cl.[7] ..... A63D 15/00; A63D 15/02; A47C 17/62; A47B 13/08

(52) U.S. Cl. ..... 473/8; 473/14; 473/11; 273/309; 108/90

(58) Field of Search ..... 473/1, 4, 8, 9, 473/10, 11, 14; 273/309, 126 R; 108/4, 90, 11

(56) References Cited

U.S. PATENT DOCUMENTS

| | | | | | |
|---|---|---|---|---|---|
| 95,765 | A | | 10/1869 | Brunswick | |
| 100,401 | A | * | 3/1870 | Held | 473/11 |
| 211,083 | A | | 1/1879 | Bensinger | |
| 471,815 | A | | 3/1892 | Fearns | |
| 693,679 | A | * | 2/1902 | Anderson | 473/11 |
| 1,540,316 | A | * | 6/1925 | Clement | 473/11 |
| 2,008,613 | A | * | 7/1935 | Hernes | 108/90 |
| 2,572,333 | A | | 10/1951 | Greitzer | |
| 2,719,717 | A | * | 10/1955 | Verity | 273/126 R |
| 3,048,459 | A | | 8/1962 | Moore | |
| 3,711,099 | A | | 1/1973 | Milu | |
| 3,941,378 | A | * | 3/1976 | Bagley | 473/10 |
| 4,345,758 | A | * | 8/1982 | Kempf | 473/475 |
| 4,519,607 | A | * | 5/1985 | Schill | 473/12 |
| 4,927,140 | A | * | 5/1990 | Pappas | 473/8 |
| D442,248 | S | | 5/2001 | Weber et al. | |

* cited by examiner

*Primary Examiner*—Paul T. Sewell
*Assistant Examiner*—Mitra Aryanpour
(74) *Attorney, Agent, or Firm*—Malloy & Malloy, P.A.

(57) ABSTRACT

A table assembly structured for selective positioning between a conventional table orientation and a gaming orientation which facilitates the playing of the game of billiards thereon. A plurality of side rails are connected to an under portion of a table top of the table assembly and movable between a stored position and an operative position which respectively define the conventional and gaming orientations. When in the stored position, the plurality of side rails are disposed in a primarily hidden location in order to enhance the table's appearance. A positioning assembly includes a plurality of linkage structures movably supporting the plurality of side rails along a complex path of travel as the plurality of side rails move between the stored and operative positions.

34 Claims, 3 Drawing Sheets

CONVERTIBLE TABLE ASSEMBLY

BACKGROUND OF THE INVENTION

1. Field of the Invention

This invention relates to a table assembly which is capable of being selectively converted between a conventional orientation, for use in a conventional manner, and a gaming orientation, for use as a gaming table suitable for playing the game of billiards and possibly other games.

2. Description of the Related Art

The game of billiards as well as the related game of "pool" or pocket billiards has enjoyed continued popularity for a number of years. A conventional billiard table generally includes an outer playing surface or face with a normally large area which may vary depending on whether the pool table is of a professional or regulation size or of a smaller size typically found in restaurants, lounges, etc. When structuring a professional or regulation table, the entire outer face is typically made from an extremely hard substance such as marble, slate, etc. Such material is generally recognized as being long lasting and relatively heavy. As such, the table includes a relatively extensive support structure made from solid wood or other materials. As a result, a conventional billiard table is typically quite heavy and includes a sufficiently large dimension and configuration to make such table assemblies either impractical or undesirable for use and installation in many locations.

In addition, the legacy of pool is such that many of the standard size tables are adorned with expensive wood working and/or inlay designs. As a result, the cost of a billiard and/or pool table can be quite high, thereby further rendering such tables undesirable for a vast majority of the consuming public. In spite of the disadvantages associated with the cost, weight, size, etc. of a pool or billiard table, the popularity of the sport has not significantly dwindled. Those interested in the playing of billiards universally recognize that a certain amount of inconvenience is involved since such tables and particularly standard size billiard tables are not practical for use in the average home.

In order to overcome the disadvantages and problems of the type set forth, there have been numerous attempts in the prior art to develop a modified table construction which is lighter, less expensive, smaller and as a result is more obtainable by the average consumer or billiards player. Conventional or known modifications in the prior art include the provision of collapsible or folding table which can be manipulated and/or otherwise oriented so as to facilitate the storage of the billiard table when not in use. In addition, even when such modified structures are left in their operative positions they are significantly lighter and usually smaller thereby enabling their positioning into and out of a stored location with relative ease. While operable and at least somewhat effective for their intended purpose foldable, collapsible or similarly structured billiard or like gaming tables may often suffer from a lack of stability. Accordingly, anyone familiar with the playing of billiards or pocket billiards is well aware that the stability of the table and playing surface is very important, especially to those who play the game on a more serious level.

As a result of the disadvantages associated with such foldable tables, further attempts in the prior art have resulted in a variety of differently structured conversion tables. This type of table assembly is capable of being selectively changed or converted from a table intended for conventional use into a gaming or other purpose table. In addition, numerous tables of this type are specifically designed and structured for the playing of billiards, pool, bumper pool, or other appropriate gaming activities.

In fact, such conversion tables do overcome at least some of the disadvantages and problems associated with collapsible gaming tables. In addition, such tables are generally less expensive, lighter and therefore more adaptable for use and/or positioning within a conventional household environment. However, such conversion tables have not gained wide spread popularity or use do at least in part to their being structured in a manner which does not truly represent the appearance of conventional table assembly when not being used as a gaming table. More specifically, the structural components or features which allow such table assemblies to be converted into a gaming table or the like, typically are obvious and/or unsightly when such table assemblies are in a conventional mode of operation.

There is a long existing need for a table assembly which can be easily and efficiently disposed between a conventional orientation and a gaming orientation. More over when in the gaming orientation such an improved table assembly should be structured to be strong, stable and include various structural features which enable the playing of at least one particular game, such as the game of billiards or pocket billiards. Also when in the conventional orientation the improved table assembly should be capable of being used in the intended manner such as a dinning room table or the like for which the table is normally used.

Importantly when in the conventional orientation, the appearance of the table assembly should be pleasing and in certain instances variable such that it is difficult or impossible to recognize that the table assembly may be converted into a gaming table. Also the versatility of such an improved table assembly should be such as to blend in with a variety of different interior designs. Finally such an improved table assembly should be formed from various materials and components which allow the playing of the intended game in a proficient manner while at the same time providing durability and a long operable life whether it is used primarily in the conventional orientation or the gaming orientation.

SUMMARY OF THE INVENTION

This invention relates to a table assembly capable of being used in the conventional manner, such as when disposed in a conventional orientation or alternatively as a gaming table, when disposed in a gaming orientation. When in the aforementioned gaming orientation the various structural and operative components of the table assembly are particularly adaptable for the playing of the game of billiards thereon. In addition, with little or no structural modification or variation, related games such as, but not limited to "pool" or pocket billiards and/or "bumper pool" can also be played. Accordingly, when the table assembly is in the gaming orientation it is emphasized that it can be used to play games other than those indicated above and still be encompassed in the intended spirit and scope of the present invention.

Accordingly, the table assembly of the present invention comprises a table top including an outer surface. The outer surface is preferably disposed in a substantially horizontal orientation and in effect defines the playing surface on which the various games are performed when the table assembly is in the gaming orientation. It is also noted that the outer surface may include some type of felt or like material covering which may be fixedly or permanently attached to the outer surface. Alternatively, the surface covering may be disposed and structured to facilitate the temporary covering of the outer surface, and used when games are to be played thereon. As such, the outer surface will remain uncovered or include a different more practical covering when used in the conventional manner such as, but not limited to, a dining table.

The table assembly of the present invention also includes a support assembly comprising a plurality of legs or a variety of other types of support bases or structures. The support assembly is fixedly secured to an under portion, wherein the under portion is disposed beneath the table top. In certain structural embodiments of the present invention the under portion may be considered a part of the overall support in that it is generally disposed in interconnecting relation between the support assembly and the table top. As such the table top, effectively rests on a brace or frame which at least partially defines the under portion. In such an embodiment, both the under portion and the table top are supported by the plurality of legs or other support structure defining the support assembly. It is also emphasized that the under portion is structured to include certain openings or spaces for the removable containment and storage of a conversion assembly and an associated positioning assembly, to be described hereinafter.

It is to be understood that the table assembly may include a variety of different dimensions and configurations. However, the overall dimension and configuration of the table assembly and in particular the table top and outer surface may be structured so as to at least generally comply with or facilitate the playing of a particular game. By way of example, the games of billiards and pocket billiards generally require the use of a rectangular table top and outer surface surrounded by raised side rails extending along each of the four sides of the aforementioned configuration. Therefore, when it is intended to convert the table assembly of the present invention from a conventional orientation into a gaming table, wherein a game of billiards is to be played, the table top will assume a generally rectangular, multi-sided configuration.

Naturally, the overall configuration of the table top could vary based on the intent to design a table assembly which may be converted into a gaming table on which games, other than billiards, pool, etc. are to be played. Therefore, while the rectangular or multi-sided configuration may be utilized in at least one preferred embodiment of the present invention, the overall dimension and configuration of the table assembly may vary greatly and still be included within the intended spirit and scope of the present invention. However, for purposes of clarity, the various preferred embodiments of the present invention will be described with reference to a table top and outer surface having a multi-sided configuration which facilitates the playing of the game of billiards thereon.

The table assembly of the present invention further includes a conversion assembly movably mounted and selectively positionable between a stored position and an operative position. Further, the conversion assembly preferably includes a plurality of conversion members sufficient in number and cooperatively disposed such that each of the conversion members, when in the aforementioned operative position, are disposed above and in overlying relation to the peripheral portions of the each of the sides of the table top.

Variations in the structuring of the conversion members may be such that each of the sides of the table top are covered by a single, elongated conversion member. Alternatively, the plurality of conversion members may be dimensioned and structured such that at least one side of the table top requires a plurality of conversion members to extend along substantially its entire length, when they are in the operative position. In one preferred embodiment, the conversion members are more specifically structured to define a side rail, of the type used in playing the game of billiards. However, it is again noted that the side rails may assume a variety of different structures which more closely correspond or are required in the playing of games other than billiards.

Another feature of each of the preferred embodiments of the present invention is the inclusion of a positioning assembly. The positioning assembly is disposed and structured to movably position and support each of the plurality of conversion members as they are moved between the stored position and the operative position. Also, at least a portion of the positioning assembly moves with the conversion members in support thereof when the conversion members are moved between the operative position and the stored position.

As set forth above, one problem associated with known or conventional types of conversion tables is the inability to present an attractive appearance when the conversion table is in its conventional orientation. It is of course desirable to utilize a conversion table as a conventional piece of furniture including its ability to fit into the surrounding motif and design features of a dining room or other area where a table is normally utilized. Therefore, one feature of the various preferred embodiments of the present invention is the ability to present an aesthetically pleasing appearance of the table assembly, particularly when the table assembly is oriented for conventional use.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
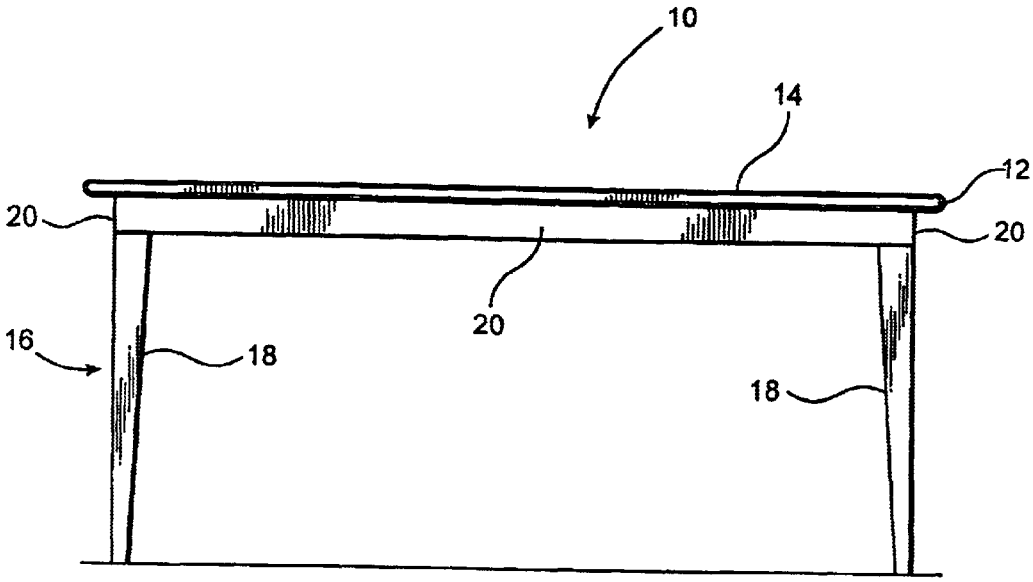
FIG. 1 is a side view of the table assembly of the present invention disposed in a conventional orientation for use in a conventional manner.
Figure 5:
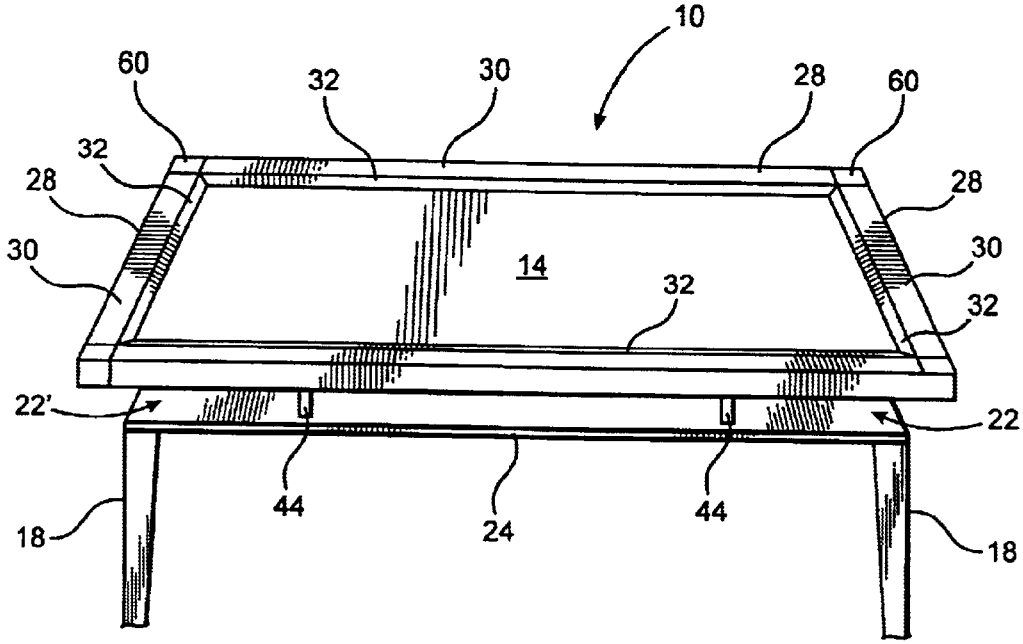
FIG. 5 is a perspective view in partial cut away of the table assembly of the present invention wherein the conversion structures or side rails are in an operative position.
Figure 6:
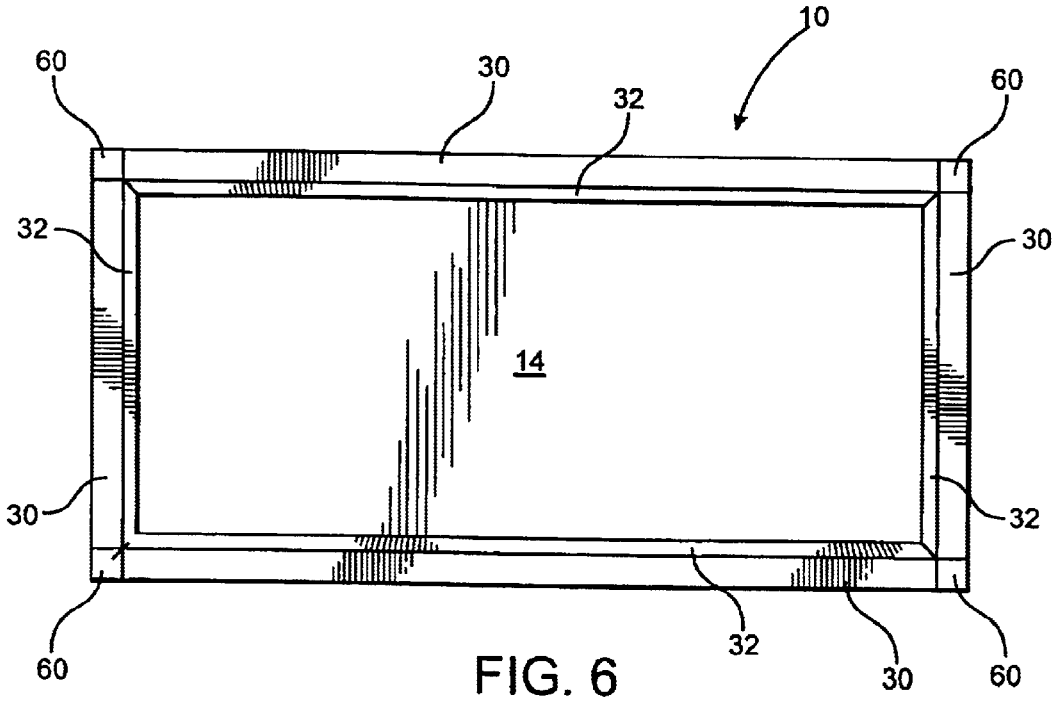
FIG. 6 is a top view of the embodiment of FIG. 5.

As shown in the accompanying drawings, the present invention relates to a table assembly generally indicated as 10 which is capable of being selectively converted between a conventional orientation, as disclosed in FIG. 1 and a gaming orientation, as disclosed in FIGS. 5 and 6. In the conventional orientation, the table assembly 10 is intended to be utilized in the normal fashion as a dinning room table or for other purposes for which tables are normally used. However, when in the gaming orientation the table assembly 10 is structured to facilitate the playing of one or more games thereon. By way of example only, the various structural features of the present invention facilitate the playing of the game of billiards, pocket billiards or any related game requiring the inclusion of a plurality of surrounding side rails or "bumpers". However, it is emphasized with minimal structural modification the various games to be played on the table assembly 10, when in its gaming orientation, could vary greatly.

Accordingly, the table assembly 10 comprises a table top 12 including an outer surface 14 and a support assembly generally indicated as 16. In the preferred embodiments disclosed, the support assembly 16 comprises a plurality of individual, spaced apart legs 18 disposed beneath and in supporting relation to the table top 12. However, it is emphasized that the support assembly 16 could take a variety of different structures including a single support base or one or more legs differing in size, location, configuration, etc. from the legs 18 as shown.

In addition, the table assembly 10 includes an apron 20. When the table assembly 10 is in its conventional orientation the apron 20 is disposed beneath the table top 12 and in somewhat surrounding relation to an under portion 22. The under portion 22 is generally and at least partially defined by a plurality of openings or spaces 22' located beneath the table top 12. The under portion 22 also may include a brace assembly and/or support frame 24 disposed in somewhat interconnecting relation between an under surface of the table top 12 and the support assembly 16. It is emphasized that the brace assembly or frame 24 may take a variety of different configurations dependent upon the overall size, configuration and intended structural integrity of the table assembly 10. However, the structural features of the brace assembly or frame segments 24 are such as to not interfere with the existence of the plurality of openings or spaces as at 22', for reasons to be explained in greater detail hereinafter.

The table assembly 10 of the present invention further comprises a conversion assembly generally indicated as 26 and including a plurality of conversion members 28. The dimension and configuration of each of the conversion members 28 are dependent, at least to some extent on the intended appearance of the table assembly 10 when in its conventional orientation of FIG. 1. However, to a greater extent, the plurality of conversion members 28 depend on the intended game or categories of games intended to be performed on the table top 12 and the outer surface 14. Again, assuming that the games to be played include billiards, pocket billiards, bumper pool, etc. the plurality of conversion members 28 will comprise side rails. As such, each of the side rails include a base 30 and a cushion portion 32. Regardless of their overall configuration and intended purpose, each of the conversion members 28 comprises an elongated configuration of sufficient length to extend along substantially the entire length, or at least a majority of the length of a correspondingly disposed side or peripheral portion 12' of the table top 12.

With reference to FIGS. 5 and 6, it is seen that each of the sides or peripheral portion 12' of the table top 12 and outer surface 14 are covered along substantially the entire lengths thereof by a single conversion member 28. However, it is recognized that in certain applications it may be desirable to include a plurality of the conversion members 28, disposed in linearly aligned relation to one another, such that more than one conversion member 28 extends along a corresponding peripheral portion or edge 12'.

Figure 2:
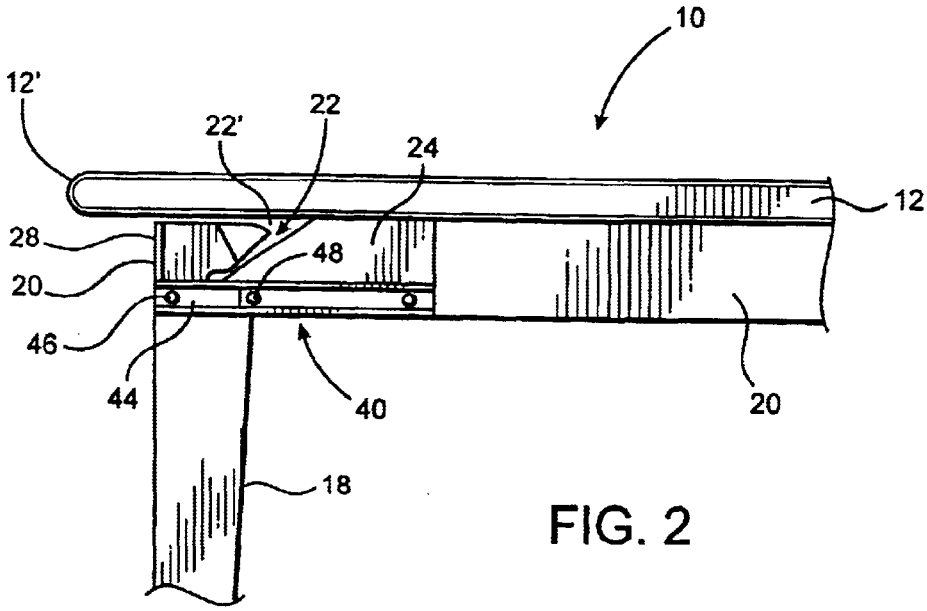
FIG. 2 is an side view in partial cutaway showing one of a plurality of conversion structures, preferably in the form of a side rail, disposed in a stored position, wherein a portion of the apron of the embodiment of FIG. 1 is removed for purposes of clarity.
Figure 3:
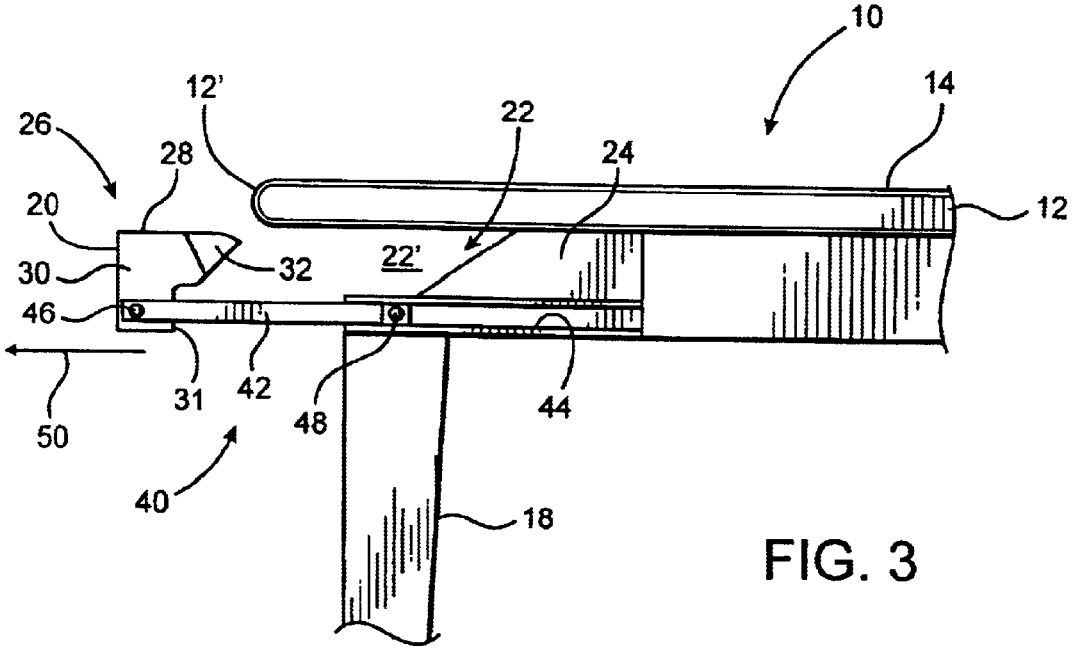
FIG. 3 is a side view in partial cutaway, wherein the conversion structure or side rail is disposed in an intermediate position between the stored position of FIG. 2 to an operative position.
Figure 4:
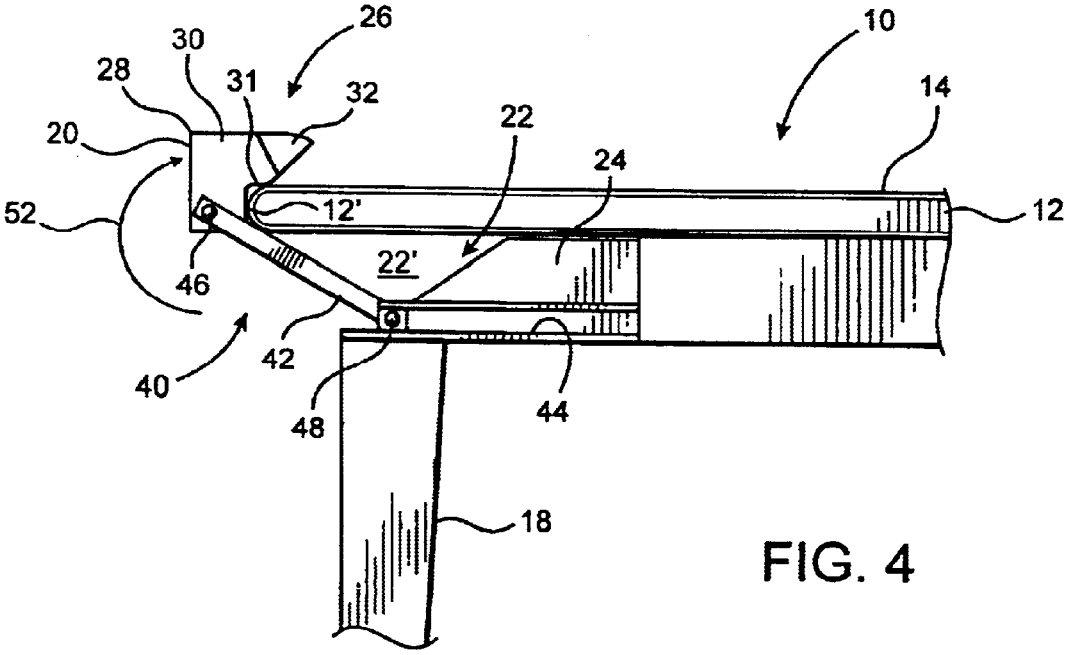
FIG. 4 is a side view in partial cutaway of one of the plurality of conversion structures or side rails being disposed in an operative position relative to a corresponding periphery of a table top of the table assembly.

With reference to FIGS. 2 through 4, each of the conversion members 28 are capable of being selectively disposed between a stored position, as shown in FIG. 2, or an operative position, as shown FIG. 4. When in the stored position, the conversion assembly 26, including each of the conversion members 28, are disposed beneath the table top 12 and at least partially within the openings or spaces 22' of the under portion 22. As such, the table assembly 10 will be disposed in the conventional orientation as shown in FIG. 1. However, when it is desired to position the table assembly 10 in the gaming orientation, as shown in FIGS. 5 and 6, each of the plurality of conversion members are moved along a predetermined path of travel from the stored position of FIG. 2 through the intermediate position of FIG. 3 and eventually into the operative position of FIG. 4.

Efficient conversion of the table assembly 10 from its conventional orientation to its gaming orientation is accomplished, at least in part, through the provision of a positioning assembly generally indicated as 40. The positioning assembly 40 comprises a plurality of linkage structures serving to movably support each of the conversion members 28 preferably, but not necessarily, independently of one another as they are moved from their stored position to their operative position.

In at least one preferred embodiment each of the linkage structures include one or more articulated links 42 slidingly or otherwise movably mounted within a supporting track 44. The supporting track 44 is secured, either movably or fixedly, to the brace assembly or support frame 24 within the under portion 22. The link or arm 42 may be pivotally or hingedly attached to the individual conversion members 28 as at 46 as well as to the remainder of the positioning assembly 40 and/or supporting track 44 including the additional link structures as at 48. Therefore, the positioning assembly 40 includes a plurality of articulated linkage structures, each of which include one or more links 42 moveable with while concurrently supporting the plurality of conversion members 28.

Again with reference to FIG. 2 through 4, as the conversion assembly 16 moves between the conventional orientation and the gaming orientation, they travel along a predetermined path of travel. This predetermined path of travel comprises what may be referred to as a complex configuration of movement including different path segments. More specifically, when it is desired to move one or more of the conversion members 28 from their stored position and their operative position, a linearly directed pulling force is exerted thereon as indicated by directional arrow 50 in FIG. 3. Once the respective conversion member 28 is removed from the openings or spaces 22' within the under portion 22 it may then pass through a rotational movement or path segment as indicated by directional arrow 52 in FIG. 4. Accordingly, when in its operative position, the conversion member 28 is disposed such that the base 30 is in overlying relation to the peripheral portion 12' of the table top 12. Also in such operative position, the cushion portion 32 is located above the peripheral portion 22 and in inwardly spaced, over hanging reaction to both the peripheral portion 12' and the outer surface 14.

While one preferred embodiment of the positioning assembly 40 includes the plurality of linkage structures, as described above, it is emphasized that the positioning assembly 40 may assume a variety of different structural configurations and operative components. The positioning assembly 40 may differ from the embodiment as set forth above in order to best facilitate the travel and placement of the plurality of conversion members 28 from the stored position of FIG. 2, through the intermediate position of FIG. 3 and eventually into the operative position of FIG. 4.

Also, when in the operative position and particularly when the conversion members 28 are in the form of side rails including base 30 and cushion portion 32, one additional preferred embodiment has the base 30 including a receiving portion 31. The receiving portion 31 is preferably in the form of an elongated recess correspondingly dimensioned and configured to matingly receive the peripheral portion 12' therein. The receiving portion 31 therefore adds overall stability to the conversion member or side rail 28 when it is disposed in its operative position of FIG. 4.

As set forth above it is of considerable importance to maintain an overall desirable appearance of the table assembly 10 particularly when it is in its conventional orientation. Therefore, when the conversion assembly 26 and specifically each of the conversion members 28 are in their respective stored positions of FIG. 2, they are at least partially disposed within the openings or spacings 22'. When so disposed, each of the conversion members are effectively hidden or in a substantially non-observable location.

In order to further enhance the appearance of the table assembly 10 when in its conventional orientation, the aforementioned aprons 20 may be secured to or considered an integral part of the outer surface of the base 30 and/or conversion member 28. Therefore, when the conversion members 28 are disposed in their respective stored positions, the aprons 20 will be automatically disposed in their conventional location as shown in FIG. 1. The appearance of the table assembly 10 is thereby enhanced, without requiring additional mounting or positioning of a detached apron 20. It is of course recognized that in certain instances it may be more desirable to removably attached the apron 20 to the various conversion members 28 or otherwise to the under portion 22. Such an additional embodiment is also contemplated within the spirit and scope of the present invention.

As shown primarily in FIGS. 5 and 6, the table assembly 10 may include corner inserts 60 or like structures. Such inserts 60 may be part of one and/or both of the adjacently positioned conversion members 28. However, as set forth above, it is also recognized that the table assembly 10, when in its gaming orientation, may be modified to play the game of pool or pocket billiards. As such, a plurality of "pockets" need be added to the table assembly 10. Therefore, the corner inserts 60 can be structured to include some type of opening or pocket like structure rather than assume the closed configuration or structure as shown in the accompanying Figures. Also the conversion members or side rails 28 may be otherwise modified to include side pockets along the appropriate sides or edges, somewhat as a conventional pool or pocket billiards table.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A table assembly structured for selective conversion into and out of a conventional orientation, said table assembly comprising:

a) a table top including an outer surface disposed in a substantially horizontal orientation and an under portion disposed beneath said table top, b) a support assembly secured adjacent to said under portion in supporting relation to said table top, c) a conversion assembly movable relative to said table top and selectively disposable between an operative position and a stored position, d) said conversion assembly disposed in substantially overlying relation to a periphery of said table top to define said operative position, and e) said conversion assembly disposed beneath said table top and at least partially within said under portion to define said stored position.

2. A table assembly as recited in claim 1 wherein at least a majority of said conversion assembly is disposed within said under portion in a substantially non-observable location when in said stored position.

3. A table assembly as recited in claim 1 wherein said conversion assembly comprises a plurality of conversion members movable between said stored position and said operative position.

4. A table assembly as recited in claim 3 wherein each of said plurality of conversion members comprises an elongated configuration dimensioned to extend along and in overlying relation to a length of said periphery of said table top when in said operative position.

5. A table assembly as recited in claim 4 wherein said plurality of conversion members are collectively dimensioned and disposed to substantially surround said outer surface when said plurality of conversion members are in said operative position.

6. A table assembly as recited in claim 5 wherein each of said conversion members is independently movable between said stored position and said operative position.

7. A table assembly as recited in claim 3 wherein said table top and outer surface comprise corresponding multi-sided configurations; one or more said plurality of conversion members extending along substantially an entire length of each side of said multi-sided configuration of said table top when said conversion members are in said operative position.

8. A table assembly as recited in claim 7 wherein said plurality of conversion members are collectively dimensioned and disposed to substantially surround said outer surface when said plurality of conversion members are in said operative position.

9. A table assembly as recited in claim 8 wherein said operative position is further defined by said conversion members disposed in overlying relation to corresponding sides of said table top.

10. A table assembly as recited in claim 3 wherein at least a majority of said conversion members are disposed within said under portion in a substantially non-observable location when in said stored position.

11. A table assembly as recited in claim 1 further comprising a positioning assembly movably connected to said under portion and secured to and at least partially movable with said conversion assembly between said stored and operative positions.

12. A table assembly as recited in claim 11 wherein said conversion assembly comprises a plurality of conversion members each independently movable between said stored position and said operative position.

13. A table assembly as recited in claim 12 wherein said positioning assembly is structured to movably support said plurality of conversion members along a predetermined path of travel between said stored and operative positions.

14. A table assembly as recited in claim 13 wherein said positioning assembly comprises a plurality of linkage structures movably interconnecting said plurality of conversion members to said table top.

15. A table assembly as recited in claim 14 wherein each of said conversion members are movably supported by at least one of said plurality of linkage structures along said predetermined path of travel.

16. A table assembly as recited in claim 15 wherein said plurality of linkage structures are structured to define a complex configuration of said predetermined path of travel, said complex configuration comprising both linear and rotational path segments of said plurality of conversion members as they travel between said stored and operative positions.

17. A table assembly structured for conversion between a conventional orientation and a gaming orientation, said table assembly comprising:

a) a table top including an outer surface disposed in a substantially horizontal orientation and an under portion disposed beneath said table top, b) a support assembly secured to said under portion in supporting relation to said table top, c) a conversion assembly movable relative to said table top into an operative position which at least partially defines the gaming orientation and into a stored position which at least partially defines the conventional orientation, d) said conversion assembly comprising a plurality of conversion members collectively structured to facilitate the playing of a game on said outer surface when said conversion assemblies are in said operative position, and e) said operative position comprising said plurality of conversion members disposed above said outer surface and in substantially overlying relation to a periphery of said table top and, f) said stored position comprising said plurality of conversion members disposed beneath said table top and at least partially within said under portion in a hidden location.

18. A table assembly as recited in claim 17 wherein said plurality of conversion members comprise a plurality of side rails, said plurality of side rails structured to facilitate the playing of a billiards game on the outer surface when said side rails are in said operative position.

19. A table assembly as recited in claim 18 wherein each of said side rails comprises an elongated configuration including a base and a cushion portion extending along the length thereof.

20. A table assembly as recited in claim 19 wherein said plurality of side rails are collectively dimensioned and disposed to substantially surround said outer surface when said plurality of side rails are in said operative position.

21. A table assembly as recited in claim 19 wherein said base of each of said plurality of side rails is disposed in overlying relation to a corresponding peripheral portion of said table top and said cushion portion of each of said side rails is disposed in inwardly spaced relation to the corresponding peripheral portion and in spaced, overlying relation to said outer surface.

22. A table assembly as recited in claim 18 further comprising a positioning assembly including a plurality of linkage structures movably interconnecting said plurality of side rails to said table top, said plurality of linkage structures at least partially movable with and disposed in supporting relation to said plurality of side rails along a predetermined path of travel between said stored and said operative positions.

23. A table assembly as recited in claim 22 wherein said plurality of linkage structures are structured to define a complex configuration of said predetermined path of travel, said complex configuration comprising both linear and rotational path segments of said plurality of side rails as they travel between said stored and said operative positions.

24. A table assembly as recited in claim 18 further comprising an apron disposed below said table top in at least partially covering relation to said under portion when said side rails are in said stored position.

25. A table assembly as recited in claim 24 wherein said apron is disposed on said base and movable therewith between said stored and operative positions.

26. An assembly structured for conversion between a conventional table and a billiard table, said assembly comprising:

a) a table top including a substantially horizontal outer surface and an under portion, b) a support assembly secured to said under portion in supporting relation to said table top, c) a conversion assembly including a plurality of side rails each positionable between a stored position and an operative position, d) said stored position comprising said plurality of side rails disposed beneath said table top and at least partially within said under portion, e) said operative position of each side rail comprising said side rail disposed above said outer surface and in substantially overlying relation to a corresponding periphery of said table top, and f) said plurality of side rails being collectively disposed and dimensioned to substantially surround said outer surface when in said operative position and thereby facilitate the playing of billiards thereon.

27. An assembly as recited in claim 26 wherein each of said plurality of side rails comprises an elongated configuration including a base and a cushion portion extending along the length of said side rails.

28. An assembly as recited in claim 27 wherein said base of each of said plurality of side rails is disposed in overlying relation to a corresponding peripheral portion of said table top and said cushion portion of each of said plurality of side rails disposed inboard of said base and in inwardly spaced relation to said outer surface.

29. An assembly as recited in claim 26 further comprising an apron disposed below said table top in at least partially covering relation to said under portion and a majority of said plurality of side rails when said plurality of side rails are in said stored position.

30. An assembly as recited in claim 29 wherein said apron is disposed on said base of at least a majority of said plurality of side rails and movable therewith between said stored and operative positions.

31. An assembly as recited in claim 27 wherein said base of at least one of said side rails comprises a receiving portion formed therein, said receiving portion disposed and config ured to matingly engage a corresponding peripheral portion of said table top.

32. An assembly as recited in claim 31 wherein said receiving portion comprises an elongated recess formed in said base, said recess configured to at least partially receive said peripheral portion therein when said side rail is in said operative position.

33. An assembly as recited in claim 26 further comprising a positioning assembly including a plurality of linkage structures movably interconnecting said plurality of side rails to said table top and disposed in supporting relation to said plurality of side rails along a predetermined path of travel between said stored and said operative positions.

34. An assembly as recited in claim 3 wherein said plurality of linkage structures are structured to define a complex configuration of said predetermined path of travel, said complex configuration comprising both linear and rotational path segments of said plurality of side rails as said plurality of side rails move between said stored and said operative positions.

* * * * *